US006517400B1

(12) United States Patent
Cho et al.

(10) Patent No.: US 6,517,400 B1
(45) Date of Patent: Feb. 11, 2003

(54) ELECTRODES IN PLASMA DISPLAY PANEL AND FABRICATION METHOD THEREOF

(75) Inventors: Soo Je Cho, Seoul (KR); Byung Gil Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/501,275

(22) Filed: Feb. 9, 2000

(30) Foreign Application Priority Data

Feb. 9, 1999 (KR) ..... 99-4374

(51) Int. Cl.[7] ..... H01J 9/02
(52) U.S. Cl. ..... 445/24; 313/582; 313/584
(58) Field of Search ..... 445/24; 313/582, 313/584

(56) References Cited

U.S. PATENT DOCUMENTS 4,812,353 A * 3/1989 Yumoto ..... 264/129
5,098,860 A * 3/1992 Chakravorty et al. ..... 205/118
6,191,530 B1 * 2/2001 Fukuta et al. ..... 313/582

FOREIGN PATENT DOCUMENTS

JP 08-222128 3/1996
JP 09-022655 1/1997

* cited by examiner

*Primary Examiner*—Kenneth J. Ramsey
(74) *Attorney, Agent, or Firm*—Fleshner & Kim, LLP

(57) ABSTRACT

An electrode in a plasma display panel and a fabrication process thereof that is capable of reducing a line width of the electrode without increasing a resistance component of the electrode. In the method, a bus electrode is provided by laminating a metal film on a certain substrate and then patterning it. A transparent electrode is provided on the substrate in a shape of surrounding the bus electrode. Accordingly, the electrode is provided by the metal film such that a limit for a selection in a width or thickness of the electrode, so that a line width of the electrode can be reduced to improve the visible light transmissivity and the electrode is formed into a large thickness instead of making a minute electrode width to lower the resistance component, thereby reducing a power consumption of the PDP.

24 Claims, 10 Drawing Sheets

ELECTRODES IN PLASMA DISPLAY PANEL AND FABRICATION METHOD THEREOF

BACKGROUND OF THE INVENTION

1. Field of the Invention

This invention relates to a plasma display panel(PDP), and more particularly to electrodes in the PDP and a fabrication method thereof that are capable of lowering their resistance components and fine-patterning them.

2. Description of the Related Art

Generally, a plasma display panel(PDP) radiates a fluorescent body by an ultraviolet with a wavelength of 147 nm generated during a discharge of He+Xe or Ne+Xe gas to thereby display a picture including characters and graphics. Such a PDP is easy to be made into a thin film and large-dimension type. Moreover, the PDP provides a very improved picture quality owing to a recent technical development. The PDP is largely classified into a direct current (DC) driving system and an alternating current(AC) driving system.

The PDP of AC driving system is expected to be highlighted into a future display device because it has advantages in the low voltage drive and a prolonged life in comparison to the PDP of DC driving system. Also, the PDP of AC driving system allows an alternating voltage signal to be applied between electrodes having a dielectric layer therebetween to generate a discharge every half-period of the signal, thereby displaying a picture. Since such an AC-type PDP uses a dielectric material, the surface of the dielectric material is charged with electricity. The AC-type PDP allows a memory effect to be produced by a wall charge accumulated to the dielectric material due to the discharge.

FIG. 1 is a sectional view showing the structure of a discharge cell in the conventional three-electrode AC-type PDP, in which a lower plate is illustrated in a state of rotating an angle of 90°. In FIG. 1, the discharge cell includes an upper plate 10 provided with a sustaining electrode pair 12 and 14, and a lower substrate 20 provided with an address electrode 20. The upper substrate 10 and the lower substrate 20 are spaced, in parallel, from each other with having a barrier rib 28 therebetween.

A mixture gas such as Ne—Xe or He—Xe, etc. is injected into a discharge space defined by the upper substrate 10 and the lower substrate 20 and the barrier rib 28. The sustaining electrode pair 12 and 14 consists of transparent electrodes 12A and 14A and metal electrodes 12B and 14B. The transparent electrodes 12A and 14A are usually made from Indium-Tin-Oxide(ITO) and has an electrode width of about 300 $\mu$m. Usually, the metal electrodes 12B and 14B take a three-layer structure of Cr—Cu—Cr and have an electrode width of about 50 to 100 $\mu$m. These metal electrodes 12A and 14A play a role to decrease a resistance of the transparent electrodes 12A and 14A6 with a high resistance value to thereby reduce a voltage drop. Any one 12 of the sustaining electrode pair 12 and 14 is used as a scanning/sustaining electrode that responds to a scanning pulse applied in an address interval to cause an opposite discharge along with the address electrode 22 while responding to a sustaining pulse applied in a sustaining interval to cause a surface discharge with the adjacent sustaining electrodes 14. A sustaining electrode 14 adjacent to the sustaining electrode 12 used as the scanning/sustaining electrode is used as a common sustaining electrode to which a sustaining pulse is applied commonly. A distance between the sustaining electrode pair 12 and 14 is set to be approximately 100 $\mu$m.

On the upper substrate 10 provided with the sustaining electrode pair 12 and 14, an upper dielectric layer 16 and a protective layer 18 are disposed. The dielectric layer 16 is responsible for limiting a plasma discharge current as well as accumulating a wall charge during the discharge. The protective film 18 prevents a damage of the dielectric layer 16 caused by a sputtering generated during the plasma discharge and improves an emission efficiency of secondary electrons. This protective film 18 is usually made from MgO. The address electrode 22 is crossed with the sustaining electrode pair 12 and 14 and is supplied with a data signal for selecting cells to be displayed. On the lower substrate 20 formed with the address electrode 24, a lower dielectric layer 24 is provided. Barrier ribs 28 for dividing the discharge space are extended perpendicularly on the lower dielectric layer 24. On the surfaces of the lower dielectric layer 24 and the barrier ribs 28 is coated a fluorescent material 26 excited by a vacuum ultraviolet lay to generate a red, green, or blue visible light.

FIGS. 2A to 2E are sectional views for explaining a process of forming the sustaining electrode pair in FIG. 2 step by step. In FIG. 2A, on the upper substrate 10 are sequentially disposed a transparent electrode material layer 12A and a photosensitive resin pattern 28. The transparent electrode material layer 12A is formed on the surface of the upper substrate 10 using the sputtering technique or the vacuum vapor deposition technique. The photosensitive resin pattern 28 is provided by forming the photosensitive resin layer on the transparent electrode material layer 12A and then patterning it.

Next, the transparent electrode 12 shown in FIG. 2B is provided by taking advantage of the photosensitive resin pattern 28 to make a patterning of the transparent electrode material layer 12A under it. The photosensitive resin pattern 28 on the transparent electrode 12 is removed. After forming the transparent electrode 12, the first chrome(Cr) thin film 30, the copper(Cu) thin film 32 and the second Cr thin film 34 are sequentially disposed as shown in FIG. 2C. The first Cr thin film 30, the Cu thin film 32 and the second Cr thin film 34 are sequentially disposed on the upper substrate 10 provided with the transparent electrode 12 using the sputtering technique.

Next, as shown in FIG. 2D, the second photosensitive resin pattern 36 is provided by forming a photosensitive resin layer on the second Cr thin film 34 and thereafter patterning it. As shown in FIG. 2E, the first Cr pattern 30A, the Cu pattern 32A and the second Cr pattern 34A are provided by taking advantage of the second photosensitive resin pattern 36 to make a sequential patterning of the second Cr thin film 34, the Cu thin film 32 and the first Cr thin film 30 under it. The first Cr pattern 30A, the Cu pattern 32A and the second Cr pattern 34A provide the bus electrode 14 shown in FIG. 1. The second photosensitive resin pattern 36 on the second Cr pattern 34A is removed.

In the conventional PDP bus electrode fabrication method as described above, the sputtering technique has been used for forming the first Cr thin film 30, the Cu thin film 32 and the second Cr thin film 34. However, the sputtering method is unsuitable for a mass production because expensive vacuum equipment must be used and a deposition time is long. In the PDP, the bus electrode 14, particularly the Cr thin film, must be thickly provided so as to lower a resistance of the bus electrode 14 to increase the efficiency. To form the bus electrode 14 thickly using the conventional PDP bus electrode fabrication method has a problem in that an adhesive force is deteriorated by a stress, etc. to enlarge a resistance component and to lengthen a deposition time. For this reason, the prior art has widened a line width of the bus electrode 14 instead of adjusting a thickness thereof so as to lower the resistance component. If the line width of the bus electrode 14 is wide, however, then most visible lights generated by a radiation of the fluorescent material 26 are reflected by the bus electrode 14 to deteriorate the efficiency.

Otherwise, to form the bus electrode 14 using the screen printing technique like the address electrode 22 has an advantage in that its fabrication process is simple, while having a drawback in that an organization of the electrode fails to be dense to increase the resistance component as well as to require an additional firing process. Also, it is difficult to make electrodes with a minute line width required for a fine structure using the screen printing technique. For instance, it is difficult to provide a bus electrode with a line width less than 100 $\mu$m using the screen printing technique.

Moreover, the conventional PDP bus electrode has a problem in that the Cu thin film is liable to be oxidized or to be diffused into the dielectric to thereby deteriorate a performance of the PDP device.

SUMMARY OF THE INVENTION

Accordingly, it is an object of the present invention to provide a method of fabricating electrodes in a PDP that is capable of forming a metal electrode with a dense organization to lower a resistance component thereof.

A further object of the present invention is to provide a method of fabricating electrodes in a PDP that is capable of forming a metal electrode with a minute line width.

A yet further object of the present invention is to provide an electrode in a PDP and a fabrication method thereof that are capable of simplifying the electrode fabrication process to improve the mass productivity of the PDP.

A still further object of the present invention is to provide an electrode in a PDP and a fabrication method thereof that are capable of preventing oxidation and diffusion of a metal electrode.

In order to achieve these and other objects of the invention, an electrode in a plasma display panel according to one aspect of the present invention includes a metal electrode provided on a certain substrate in a specified pattern and formed of a metal film. The electrode further includes a transparent electrode provided on the substrate in a shape of surrounding the metal electrode.

A method of fabricating an electrode in a plasma display panel according to another aspect of the present invention includes the step of providing a metal electrode by laminating a metal film on a certain substrate and thereafter patterning it. The method further includes the step of providing a transparent electrode on the substrate in a shape of surrounding the metal electrode.

An electrode in a plasma display panel according to still another aspect of the present invention includes a metal electrode consisting of a metal seed layer and an electroplating film disposed on a certain substrate in the same pattern.

A method of fabricating an electrode in a plasma display panel according to still another aspect of the present invention includes the step of providing a metal seed layer on a certain substrate; providing a photo-sensitive resin pattern on the upper portion of the metal seed layer; providing an electroplating film on the metal seed layer exposed through the photo-sensitive resin pattern; and removing the photo-sensitive resin pattern and the metal seed layer under it.

An electrode in a plasma display panel according to still another aspect of the present invention includes a metal electrode consisting of a non-electrolytic plating film and an electroplating film disposed on a certain substrate in the same pattern.

A method of fabricating an electrode in a plasma display panel according to still another aspect of the present invention includes the step of providing a photo-sensitive resin pattern on a certain substrate; providing a non-electrolytic plating film on the substrate exposed through the photo-sensitive resin pattern; providing an electroplating film on the non-electrolytic plating film; and removing the photo-sensitive resin pattern.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
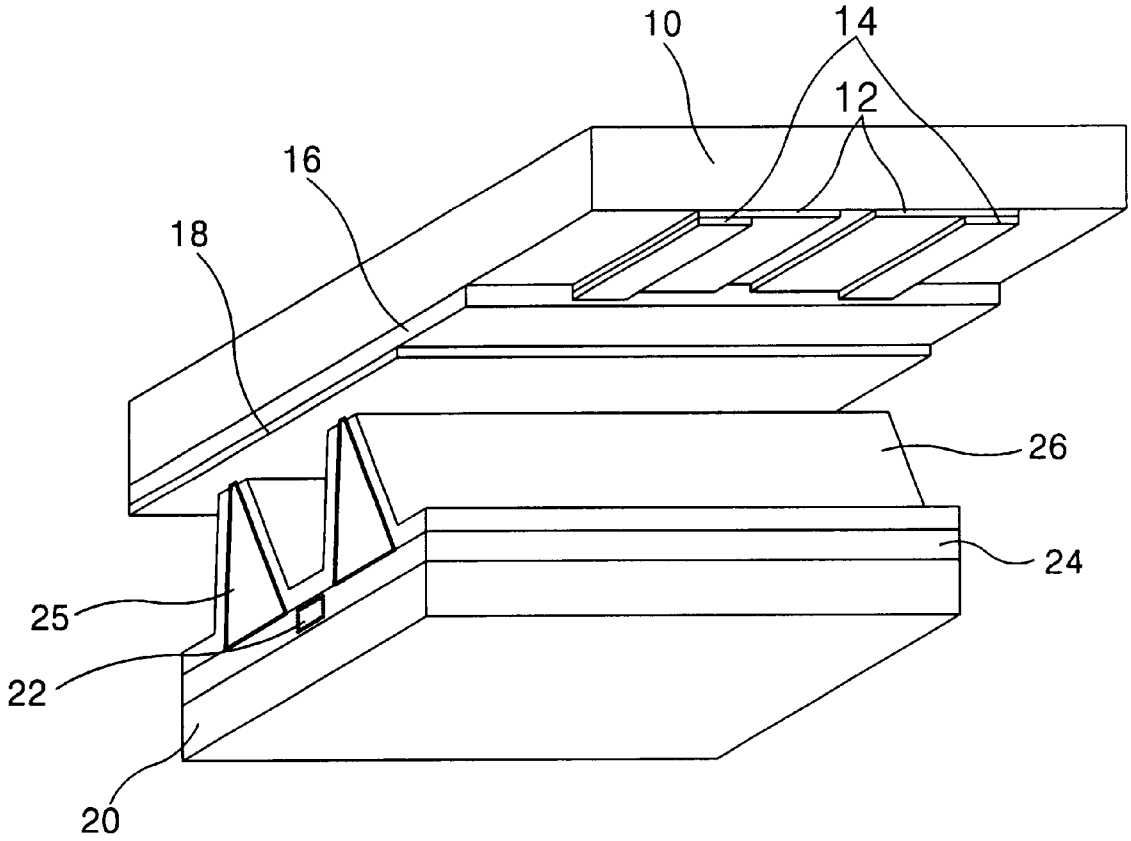
FIG. 1 RELATED ART
FIG. 1 is a perspective view showing the structure of a discharge cell in a conventional three-electrode, AC-type plasma display panel.
Figure 2A:
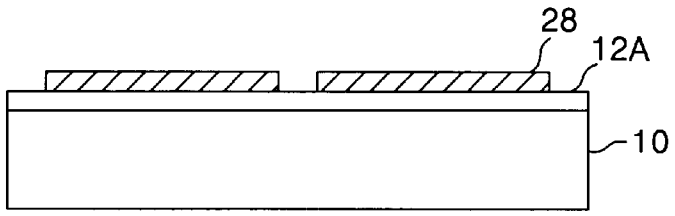
FIG.2A RELATED ART
FIGS. 2A to 2E are sectional views for explaining a fabrication process of the sustaining electrode shown in FIG. 1.
Figure 2B:
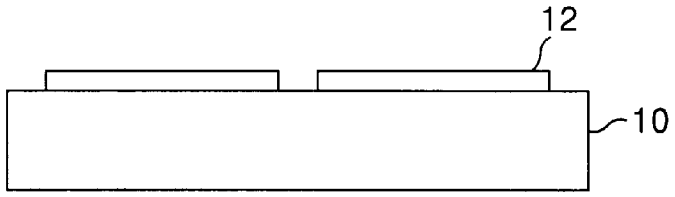
FIG.2B RELATED ART
Figure 2C:
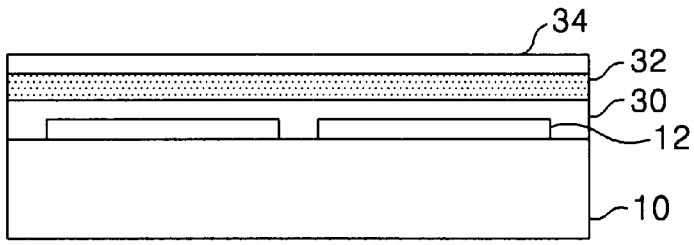
FIG.2C RELATED ART
Figure 2D:
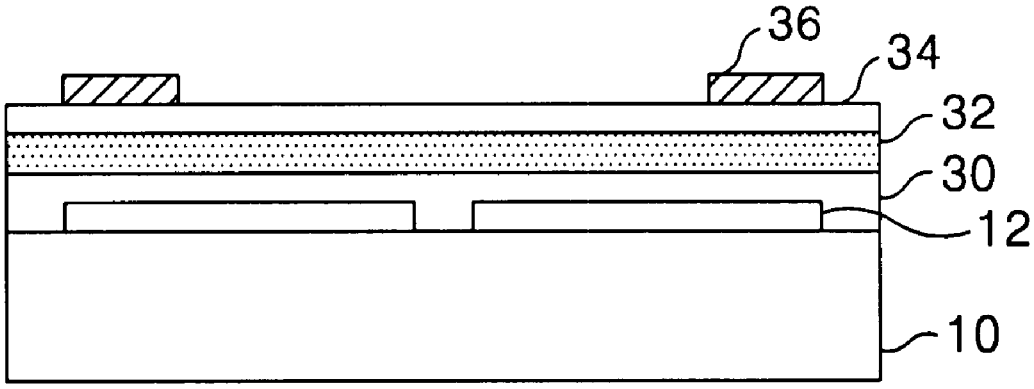
FIG. 2D RELATED ART
Figure 2E:
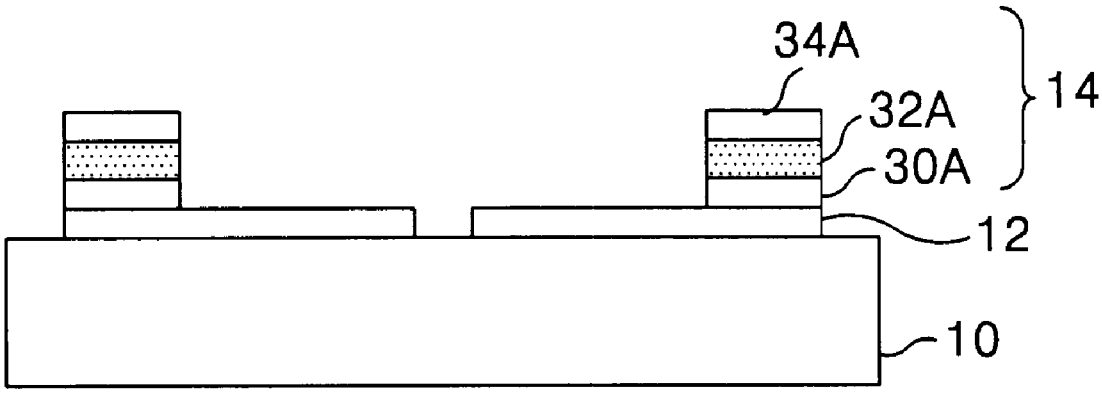
FIG. 2E RELATED ART
Figure 3A:
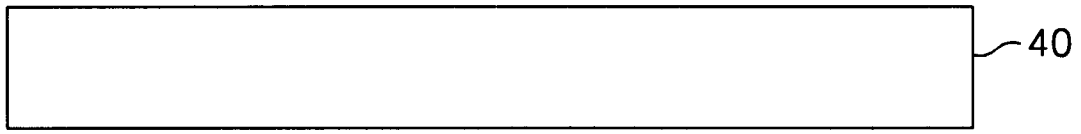
FIGS. 3A to 3F are sectional views for explaining a method of fabricating electrodes in a PDP according to an embodiment of the present invention.
Figure 3B:
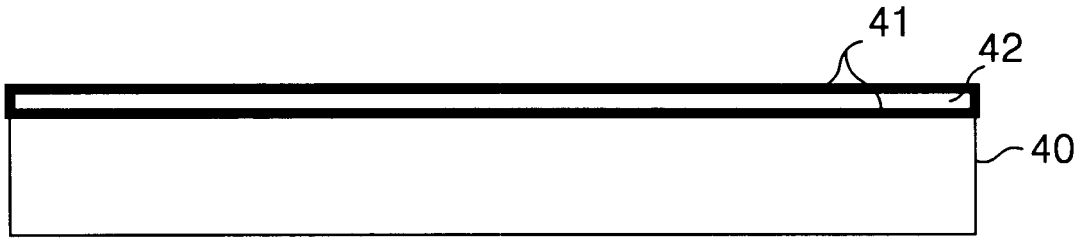

FIGS. 3A to 3F explains a method of fabricating electrodes in a PDP according to an embodiment of the present invention step by step. After a certain transparent substrate 40 was prepared as shown in FIG. 3A, a separately prepared metal film 42 is laminated on the transparent substrate 40 as shown in FIG. 3B. In this case, the metal film 42 is laminated on the transparent substrate 40 by a ceramic paste or other appropriate laminating methods. When the ceramic paste is used, the metal film 42 is laminated on the transparent substrate 40 by coating the ceramic paste on the transparent substrate 40 and then temporarily laminating the transparent substrate 40 thereon and firing it. As the metal film 42 is used a copper film or an aluminum film with a good conductivity. Since problems in a deterioration of electrode characteristic and a resistance increase caused by an oxidation may occur in the later dielectric firing process, however, an anti-oxidation film 41 made from chrome(Cr) or molybdenum (Mo), or Cr alloy or Mo alloy is provided on and under the metal film 42 by an appropriate method. Herein, a Cr film or a Mo film is formed by the vacuum deposition or sputtering technique. Particularly, the Cr film may be formed by the electroplating technique. This anti-oxidation film 41 is provided on and under the metal film 42 before the metal film 42 is laminated on the transparent substrate 40. Otherwise, the anti-oxidation film 41 may be provided only on the metal film 42 after laminating the metal film 42.

Figure 3C:
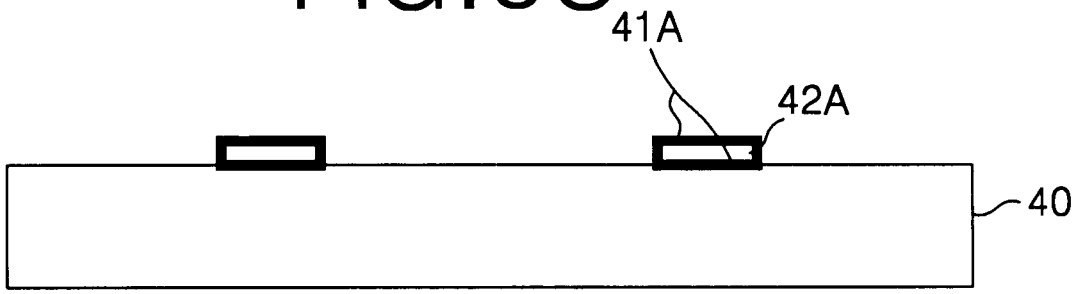

As shown in FIG. 3C, a bus electrode 42A and an anti-oxidation film pattern 41A are provided by patterning the metal film 42 and the anti-oxidation film 41 after laminating the metal film 42. The bus electrode 42A and the anti-oxidation film pattern 41A are provided by etching the metal film 42 and the anti-oxidation film 41 on and under the metal film 42 into a desired shape using the photolithography.

Figure 3D:
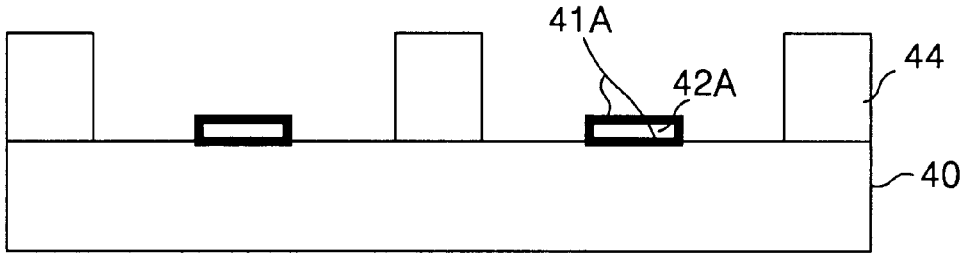

After forming the bus electrode 42A and the anti-oxidation film pattern 41A, a photosensitive resin pattern 44 is formed in parallel to the bus electrode 42A on the transparent substrate 40 as shown in FIG. 3D. The photosensitive resin pattern 44 is provided in parallel with having a desired space from the bus electrode 42A by patterning a photo-sensitive resin layer into a desired shape using the photolithography after forming the photo-sensitive resin layer on a substrate 40 provided with the bus electrode 42A and the anti-oxidation pattern 41A.

Figure 3E:
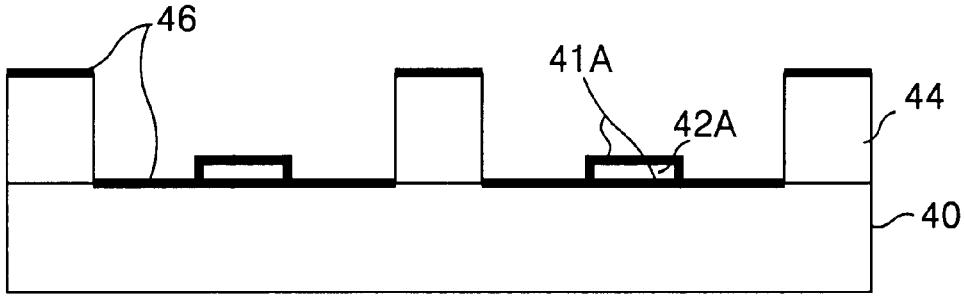

After forming the photosensitive resin pattern 44, a transparent electrode material (ITO) layer 46 is provided on the entire surface of the photosensitive resin pattern 44 as shown in FIG. 3E. The transparent electrode material layer 46 is provided on the surfaces of the anti-oxidation pattern 41A and the photo-sensitive resin pattern 44 and on the exposed transparent substrate 40 by the vacuum deposition, sputtering or ion plating techniques, etc.

Figure 3F:
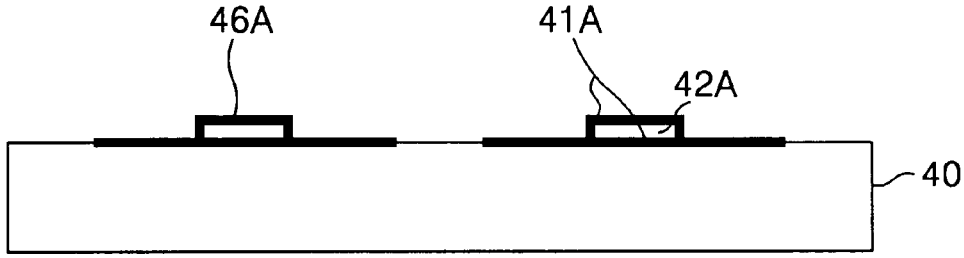

Subsequently, a transparent electrode 46A is provided by removing the photosensitive resin pattern 44 as shown in FIG. 3F. The transparent electrode 46A is formed in a shape of surrounding the bus electrode 42A by removing the photo-sensitive resin pattern 44 along with the transparent electrode material layer 46 thereon using an appropriate solvent such as acetone, etc. As a result, the sustaining electrode including the bus electrode 42A provided on the transparent substrate 40 and the transparent electrode 46A formed in a shape of surrounding the bus electrode 42A. The anti-oxidation pattern 41A is positioned on the upper and lower portions of the bus electrode 42A.

As described above, the PDP bus electrode fabrication method according to the present invention does not use the sputtering process, but makes use of the metal film prepared separately upon forming the metal electrode, so that it is capable of easily providing a thick metal electrode. As the metal electrode is thickly formed, a line width of the metal electrode can be reduced without increasing the resistance component. In addition, the anti-oxidation pattern is provided on the surface of the metal electrode, so that the oxidation and diffusion of the metal electrode can be prevented. The above method of forming the metal electrode using the metal film is applicable to the address electrode besides said bus electrode.

Figure 4A:
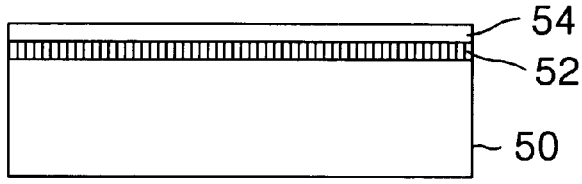
FIGS. 4A to 4E are sectional views for explaining a method of fabricating electrodes in a PDP according to another embodiment of the present invention.

FIGS. 4A to 4E explains a PDP electrode fabrication process according to another embodiment of the present invention step by step. As shown in FIG. 4A, a metal seed layer 53 is provided after a transparent substrate 50 was prepared. The metal seed layer 53 is formed by sequentially disposing a first metal layer 52 and a second metal layer 54 on the transparent substrate 50 using the sputtering technique or the vacuum vapor deposition technique. The first metal layer 52 improves an adhesive force between the transparent substrate 50 and the second metal layer 54. To this end, the first metal layer 52 is made from a metal such as Ti, Cr or Ta, etc. The first metal layer 52 preferably has a thickness of about less than 0.05 $\mu$m. The second metal layer 54 serves as a seed of a plating film to be formed in the later process. To this end, the second metal layer 54 is made from Cu, Ag or Au or other appropriate metal or alloy. Preferably, the second metal layer 54 has a thickness of about 0.05 to 0.5 $\mu$m.

Figure 4B:
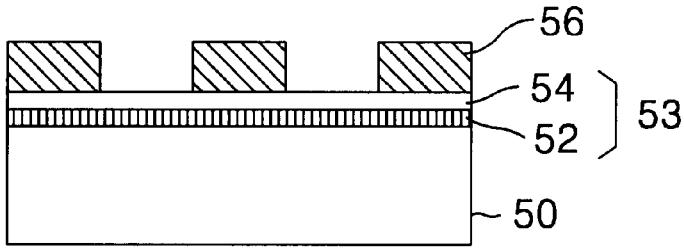

After forming such a metal seed layer 53, photosensitive resin patterns 56 are provided as shown in FIG. 4B. The photosensitive resin patterns 56 are provided by fully coating a photosensitive resin on the metal seed layer 53 and thereafter patterning it using the photolithography.

Figure 4C:
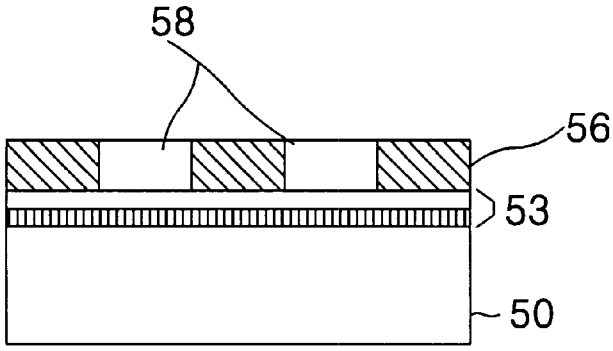

After forming the photosensitive resin patterns 56, electroplating films 58 are provided between the photosensitive resin patterns 56 as shown in FIG. 4C. The electroplating films 58 are provided on the metal seed layer 53 exposed between the photosensitive resin patterns 56 by the electroplating technique. The electroplating film 58 is made from Cu, Ni, Ag, Au, Cr, Sn, Pb, Pt or other appropriate metals or alloy. Considering economical, resistivity and environmental problems, Cu or Cu alloy is preferably used. The electroplating film 58 is preferably set to have a width of 10 to 100 $\mu$m and a thickness of 1 to 20 $\mu$m in consideration of a characteristic of PDP. The electroplating film 58 may be set to a width of less than 10 $\mu$m such that it has a minute line width for the purpose of making the fine structure. Since the electroplating film 58 is formed by the electroplating technique, it has a dense organization to reduce a resistivity value and hence lower the resistance component.

Figure 4D:
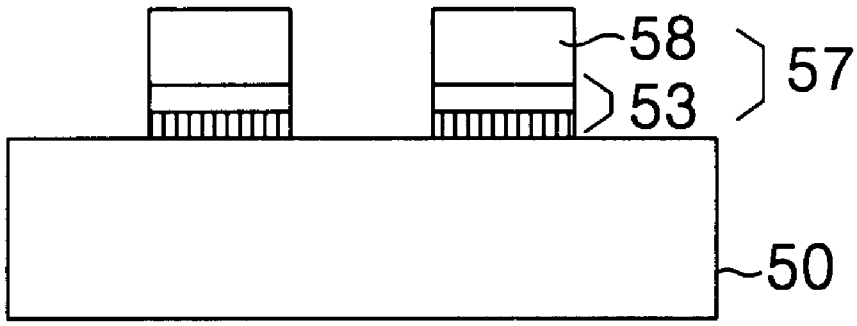

After forming the electroplating film 58, a metal electrode pattern 57 is provided by removing the photosensitive resin pattern 56 and patterning the metal seed layer 53 under it as shown in FIG. 4D. The photosensitive resin pattern 56 is removed out using an acetone or other proper solvent. Then, the metal electrode pattern 57 is completed by etching the metal seed layer 53 exposed by the removal of the photosensitive resin pattern 56 using the wet etching method or the reactive ion etching method, etc. This metal electrode pattern 57 has a structure of disposing the metal seed layer 53 and the electroplating film 58 thereon.

Figure 4E:
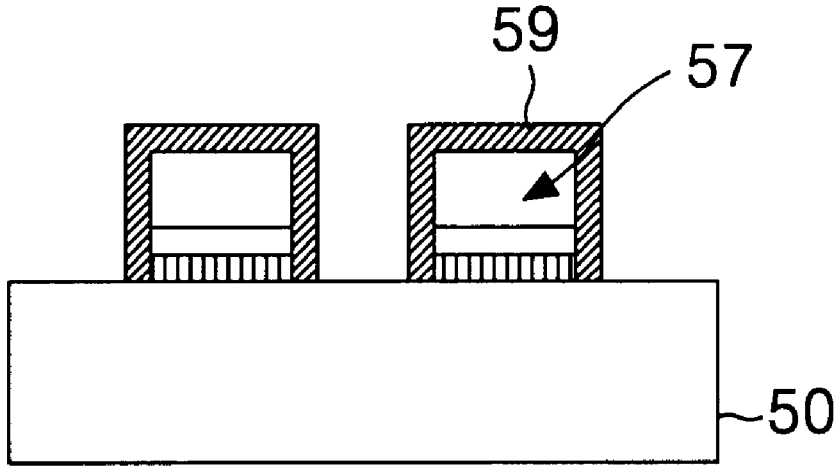

After forming the metal electrode pattern 57, a protective film 59 is provided on the metal electrode pattern 57 as shown in FIG. 4E. The protective film 59 aims at preventing an oxidation and a diffusion into dielectric of a metal material (particularly, Cu) making the metal electrode pattern 57, and which is provided on the surface of the metal electrode pattern 57 by the electroplating technique. As the protective film 59 is used a Ni film, a Cr film or their alloy film, or a Ni/Cr deposited film.

Such a metal electrode fabrication process using the electroplating technique is applicable to the bus electrode or the address electrode included in the sustaining electrode in the PDP. When the bus electrode in the sustaining electrode is formed, the transparent electrode is provided on the transparent substrate 50 before the metal seed layer 53 in FIG. 4A is formed.

Figure 5A:
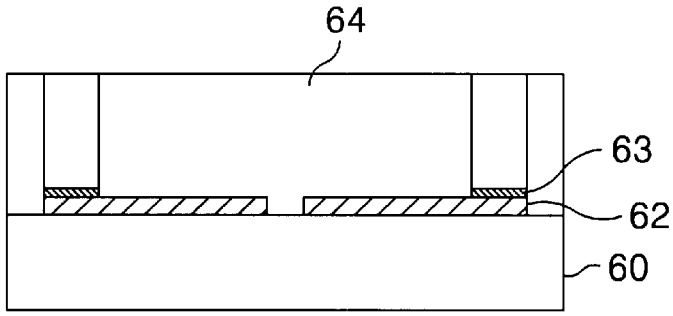
FIGS. 5A to 5E are sectional views for explaining a method of fabricating electrodes in a PDP according to still another embodiment of the present invention.

FIGS. 5A to 5E explains a PDP electrode fabrication process according to still another embodiment of the present invention step by step. As shown in FIG. 5A, a transparent electrode 62 and a photosensitive resin pattern 64 are sequentially disposed on a transparent substrate 60. The transparent electrode 62 is provided by fully coating a transparent electrode material (ITO) on the transparent substrate 60 and thereafter patterning it. The photosensitive resin pattern 64 is provided by forming a photosensitive resin layer or a photosensitive dry film on the transparent substrate 60 provided with the transparent electrode 62 and then patterning it using the photolithography. One side of each transparent electrode 62 is exposed through the photosensitive resin pattern 64. On one side of the exposed transparent electrode 62 is formed a catalyst layer 63 for the non-electrolytic plating by the vacuum vapor deposition technique. This catalyst layer 63 is made from a metal material such as Pd, Au, Ag or Pt, etc. The catalyst layer 63 made from Pd may be formed of first tin chloride and palladium chloride.

Figure 5B:
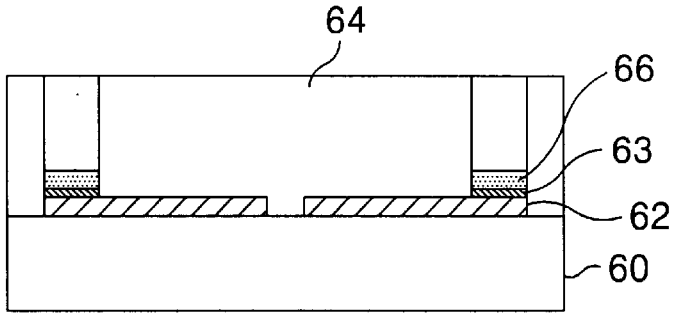

After forming the catalyst layer 63, a non-electrolytic plating film 66 is provided on the catalyst layer 63 as shown in FIG. 5B. The non-electrolytic plating film 66 is formed by the non-electrolytic plating technique. Ni is preferably used as a material of the non-electrolytic plating film 66, but Cu, nickel alloy or copper alloy may be used as needed. A dense organization of the non-electrolytic plating film 66 can be obtained by forming the non-electrolytic plating film 66 and thereafter making a thermal treatment of it.

Figure 5C:
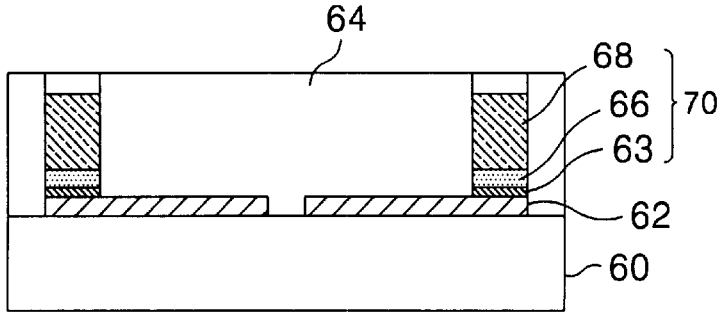
Figure 5D:
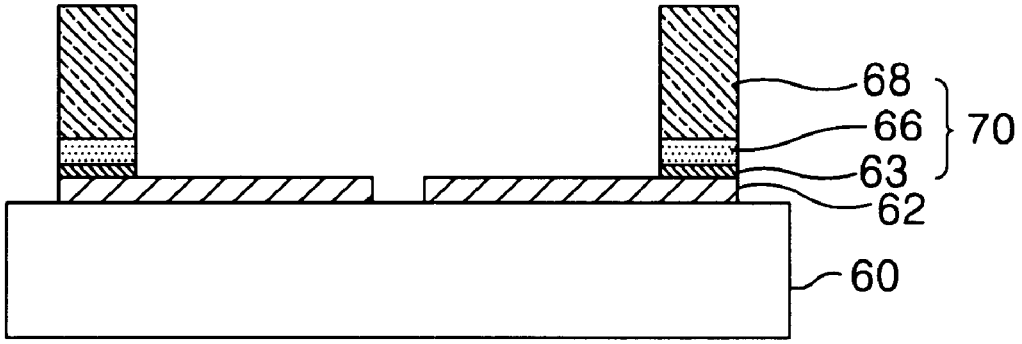

After forming the non-electrolytic plating film 66, a plating film 68 is provided on the non-electrolytic plating film 66 as shown in FIG. 5C. The plating film 68 is formed into a relatively larger thickness than the non-electrolytic plating film 66 by the electroplating technique. The plating film 68 is made from a metal material such as Cu, Ag, Au or Ni, etc. Also, alloy plating may be used as a material of the plating film 68, but Cu is most preferably used in light of the electric resistance and the material cost. The plating film 68 can be easily formed into a desired thickness on the basis of width. For example, the plating film 68 is preferably set to have a width of 10 to 100 $\mu$m and a thickness of 2 to 50 $\mu$m. A bus electrode 70 consists of the plating film 68 and the non-electrolytic plating film 66 under it.

Figure 5E:
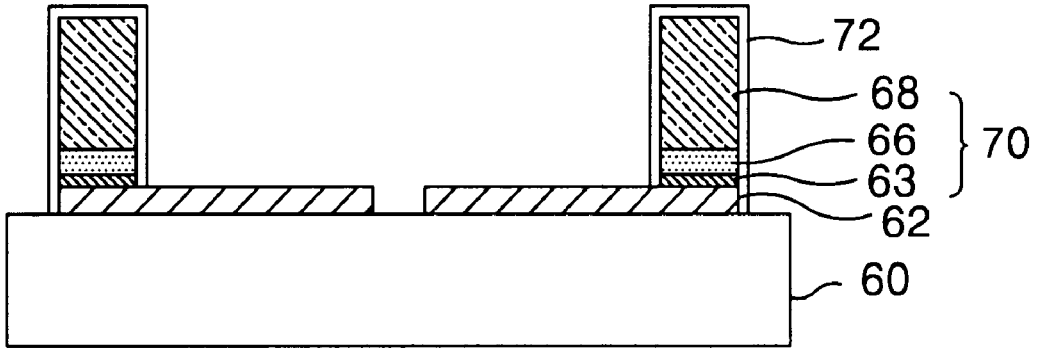

After forming the bus electrode 70, the photosensitive resin pattern 64 is removed as shown in FIG. 4D. As shown in FIG. 5E, a protective film 72 may be further coated on the surface of the bus electrode 70. The protective film 72 plays a role to prevent an oxidation or a diffusion of the metal electrode material and is formed by the electroplating technique. As the protective film 72 is used a Ni film, a Cr film, their alloy film or a Ni/Cr deposition film. Meanwhile, since a plating may be generated at the catalyst film of the transparent electrode 62 upon forming the protective film 72, a catalyst layer on the transparent electrode 62 is removed by an appropriate etching process before plating, or only a plating film on the transparent electrode 62 is selectively removed after plating.

As described above, the electrode fabrication method according to the present invention does not use the sputtering and screen printing techniques, but it uses the electroplating technique or the non-electrolytic plating/electrical plating technique, so that it is capable of shortening an electrode fabrication time to be suitable for the mass production. Also, the PDP electrode fabrication method according to the present invention can form a metal electrode with a dense organization, thereby lowering the resistance component. Accordingly, the metal electrode can be set to have more narrow width while having a relatively larger thickness, so that an electrode with a minute line width required for a high resolution can be easily provided.

Figure 6A:
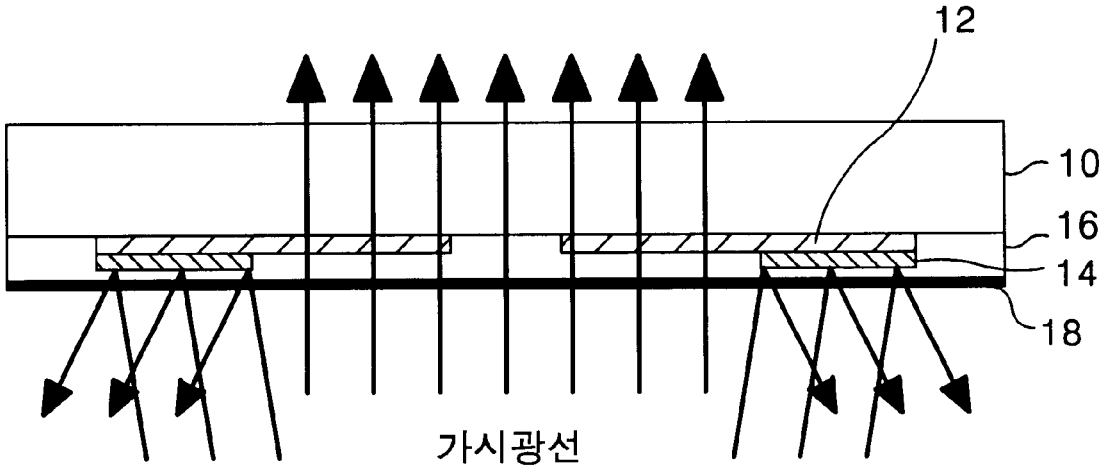
FIG. 6A and FIG. 6B are views for comparing a visible light transmissivity of the conventional bus electrode with that of a bus electrode according to the present invention.
Figure 6B:
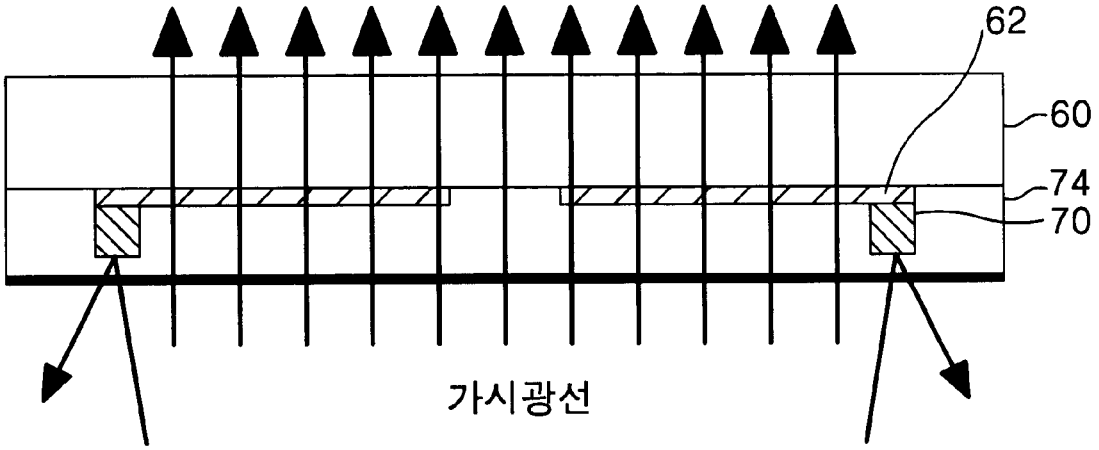

FIG. 6A and FIG. 6B compares a visible light transmissivity of a PDP using the conventional bus electrode with that of a PDP using a bus electrode according to an embodiment of the present invention. In the PDP shown in FIG. 6A, since the conventional bus electrode 14 is provided by the sputtering technique such that it is difficult to form the bus electrode into a large thickness, it has a wide line width. For this reason, most visible lights generated from a fluorescent material (not shown) are reflected by the bus electrode 14 to thereby deteriorate the brightness and the efficiency. On the other hand, in a PDP shown in FIG. 6B, the present bus electrode 70 is provided by the electrical plating technique or the non-electrolytic plating/electroplating technique, so that it has a narrow width and a large thickness. Accordingly, an amount of lights reflected by the bus electrode 70 is decreased while an amount of lights transmitted through the transparent electrode 62 and the transparent substrate 60 is increased, so that the brightness and the efficiency can be improved. Also, as a resistance value of the bus electrode 70 can be lowered, the power consumption can be reduced. In addition, a protective film (not shown) is formed on the surface of the bus electrode 70, so that an oxidation and diffusion into dielectric 72 of the bus electrode 70 can be prevented.

As a result, according to the present invention, the metal electrode is provided using the metal film or using the electroplating technique or the non-electrolytic plating/electrical plating technique to almost eliminate a limit for a selection of the width or thickness of the metal electrode, the metal electrode with a minute line width can be provided to improve the visible light transmissivity. Also, the metal electrode is set to a large thickness instead of reducing a width thereof, a resistance value can be lowered to thereby reduce a power consumption of the PDP. Furthermore, according to the present invention, since the metal electrode is provided by the metal film or by the electroplating technique or the non-electrolytic plating/electrical plating technique, an expensive sputtering equipment and process is not required unlike the prior art, thereby reducing the cost as well as simplifying the process to improve the mass productivity. Also, the protective film is provided on the surface of the metal electrode, so that an oxidation and a diffusion of the metal electrode can be prevented.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electrode in a plasma display panel, comprising:

a metal electrode provided on a substrate in a specified pattern, said metal electrode being formed of a metal film laminated to the substrate with a ceramic paste.

2. The electrode according to claim 1, further comprising:

an anti-oxidation film formed on the upper and lower portions of the metal electrode to prevent an oxidation of the metal electrode.

3. The electrode according to claim 2, wherein said anti-oxidation film is made from any one of Cr, Mo, Cr alloy and Mo alloy.

4. The electrode according to claim 1, wherein said metal electrode is made from any one of a copper film and an aluminum film.

5. The electrode according to claim 1, further comprising:

a transparent electrode provided on the substrate shaped to surround the metal electrode.

6. A method of fabricating an electrode in a plasma display panel, comprising:

providing a metal electrode by laminating a metal film on a substrate using a ceramic paste and patterning the metal film.

7. The method according to claim 6, wherein said providing of the metal electrode includes forming an anti-oxidation film on the upper and lower portions of the metal film before laminating the metal film.

8. The method according to claim 7, wherein said providing of the metal electrode includes laminating a metal film selected from any one of a copper film and an aluminum film.

9. The method according to claim 7, wherein said anti-oxidation film is made from any one of Cr, Mo, Cr alloy and Mo alloy.

10. The method according to claim 6, wherein said providing of the metal electrode includes forming an anti-oxidation film on the upper portion of the metal film after laminating the metal film.

11. The electrode according to claim 1, further comprising:

an anti-oxidation film formed on the upper and lower portions of the metal electrode to prevent an oxidation of the metal electrode; and a transparent electrode provided on the substrate shaped to surround the metal electrode, wherein said metal electrode is made from any one of a copper film and an aluminum film, and wherein said anti-oxidation film is made from any one of Cr, Mo, Cr alloy and Mo alloy.

12. The method according to claim 6, further comprising:

providing a transparent electrode on the substrate shaped to surround the metal electrode.

13. The method according to claim 12, wherein said providing of the transparent electrode includes:

forming a photosensitive resin pattern in parallel to the metal electrode on the substrate;

forming a transparent electrode material layer on the surfaces of the metal electrode and the photosensitive resin pattern and the substrate; and removing the photosensitive resin pattern along with the transparent electrode material layer thereon.

14. A method of fabricating an electrode in a plasma display panel, comprising:

providing a photosensitive resin pattern on a substrate;

providing a non-electrolytic plating film on the substrate exposed through the photosensitive resin pattern;

providing an electroplating film on the non-electrolytic plating film; and removing the photosensitive resin pattern.

15. The method according to claim 14, further comprising:

providing a catalyst layer for forming the non-electrolytic plating film on the substrate.

16. The method according to claim 15, wherein a material of said catalyst layer is selected from any one of Pb, Au, Ag and Pt.

17. The method according to claim 15, wherein said catalyst layer is formed by the vacuum deposition technique.

18. The method according to claim 14, wherein a material of said non-electrolytic plating film is selected from any one of Ni, Cu and their alloy.

19. The method according to claim 14, wherein said electroplating film is thicker than the non-electrolytic plating film.

20. The method according to claim 14, further comprising:

providing a protective film on the surface of the metal electrode consisting of the non-electric plating film and the electroplating film using the electroplating technique.

21. The method according to claim 20, further comprising:

providing a transparent electrode on the substrate before forming the photosensitive resin pattern.

22. The method according to claim 21, further comprising:

removing the catalyst layer provided on the transparent electrode before forming the protective film.

23. The method according to claim 21, further comprising:

removing only the protective film plated on the transparent electrode after forming the protective film.

24. The method according to claim 14, further comprising the step of:

making a thermal treatment of the non-electrolytic plating film.

* * * * *